United States Patent [19]

Lo

[11] Patent Number: 4,627,252

[45] Date of Patent: Dec. 9, 1986

[54] CODED-CARD TYPE LOCK DEVICE

[76] Inventor: Chi-Woei Lo, 39, New Village, Fu-Shin-Li, Miao-Li City, Taiwan

[21] Appl. No.: 797,839

[22] Filed: Nov. 14, 1985

[51] Int. Cl.[4] ..... E05B 23/00

[52] U.S. Cl. ..... 70/351; 70/385

[58] Field of Search ..... 70/351, 350, 343, 349, 70/352, 382, 385, 405

[56] References Cited

U.S. PATENT DOCUMENTS

| | | | |
|---|---|---|---|
| 14,896 | 5/1856 | Lippincott | 70/351 |
| 17,714 | 6/1857 | Baier | 70/351 |
| 2,557,028 | 6/1951 | Deutsch | 70/363 |
| 4,287,737 | 9/1981 | Ahn | 70/352 |
| 4,587,815 | 5/1986 | Gill | 70/352 |

FOREIGN PATENT DOCUMENTS

| | | | |
|---|---|---|---|
| 295118 | 11/1930 | Italy | 70/351 |

*Primary Examiner*—Robert L. Wolfe

[57] ABSTRACT

A coded-card type lock device includes in combination: an outer housing body for being fixed on a door; a locking unit with a sliding slot and a plurality of partitioning spaces installed in the outer housing body; a plurality of mechanically coded locking pieces movably installed in the partitioning spaces according to a selected code; an operating mechanism movably disposed under the locking unit in the outer housing body for unlocking operation; a resetting member slidingly provided around the periphery of the locking unit for resetting the locking unit to a coded lock position; a lock bolt mechanism movably installed at a front portion of the outer housing body in connection with the operating mechanism; an inner covering member secured over the back side of the outer housing body; and a card-type key having a plurality of segmented sections coded according to the code of the locking pieces for effecting the unlocking operation; and a bolt socket frame matched with the bolt mechanism and fixed on a door frame; thereby, code can be changed at any time to ensure highly protective capability of the lock device.

8 Claims, 9 Drawing Figures

(B)

(C)

CODED-CARD TYPE LOCK DEVICE

BACKGROUND OF THE INVENTION

This invention relates in general to a coded lock device and in particular to a coded-card type lock device in which a calling-card type key and a digitalized locking unit are arranged to be locked and unlocked. The card-type key is selectively provided with numerical or alphabaetical codes while the locking unit has a plurality of digitalized locking pieces which are mechanically designed on a binary basis and reversibly disposed in the locking unit in cooperation with the card-type key so that the codes of both the card-type key and the locking pieces can be simultaneously set at any time for ensuring its highly protective capability At present, the conventional door locks have the following disadvantages:

(1) As the known door lock such as the snap type is usually combined with pin tumblers and spring for locking and unlocking, it is easy for any unauthorized person to unlock it with a probe.

(2) If the key is lost or not carried along, it has to be unlocked by a locksmith, incurring a lot of inconvenience.

(3) On the occasions where the key is lost or often transferred from person to person such as for a rent room or a hotel room, more duplications of the same key have to be made, always posing a safety problem.

(4) Traditional keys are usually made with different serrations, slots and wards. When they are strung together, it is not only heavy and inconvenient to use and carry, but also bulky and noisy when carried in one's pocket.

(5) Electronic or magnetic door locks produced for surmounting the aforesaid disadvantages are expensive and, moreover, are not as sturdy and taugh as mechanical door locks.

SUMMARY OF THE INVENTION

It is therefore a main object of this invention to provide a novel coded-card type door lock device to eliminate the above-mentioned disadvantages found with the known door locks.

This and other objects are achieved by providing a coded-card type door lock device which comprises in conbination: an outer housing body for being fixed in the door; an inner covering member to be coupled with the outer housing body; a locking unit with a plurality of digitalized locking pieces installed in the outer housing body for controlling the locking and unlocking operations; an operating mechanism having a sliding rod and a rotating member disposed in the outer housing body in connection with the locking unit for providing a link-up movement therewith; a lock bolt mechanism disposed in the front end of the outer housing body in conjunction with the operating mechanism for effecting engaging and disengaging thereat; a lock-bolt frame socket corresponding to the lock bolt mechanism fixed on the door post or frame along with the outer housing body for accommodating the lock bolt; a resetting member having a linking bar and a hand grip movably connected to the locking unit around the periphery thereof with the hand grip extending out of the outer housing body for setting the locking pieces into their locked state; and a card-type key having a plurality of segmented tooth-like sections selectively arranged in a code setting in cooperation with the code arrangement of the locking pieces; thereby, the locking and unlocking operations can be conveniently performed, and the codes of both the locking unit and the card-type key can be re-arranged also for ensuring a high standard of security.

Other objects and advantages and salient features of this invention will become apparent from the following detailed description when taken in conjunction with the annexed drawings.

DETAILED DESCRIPTION OF THE PREFERRED EMBODIMENT

Figure 1:
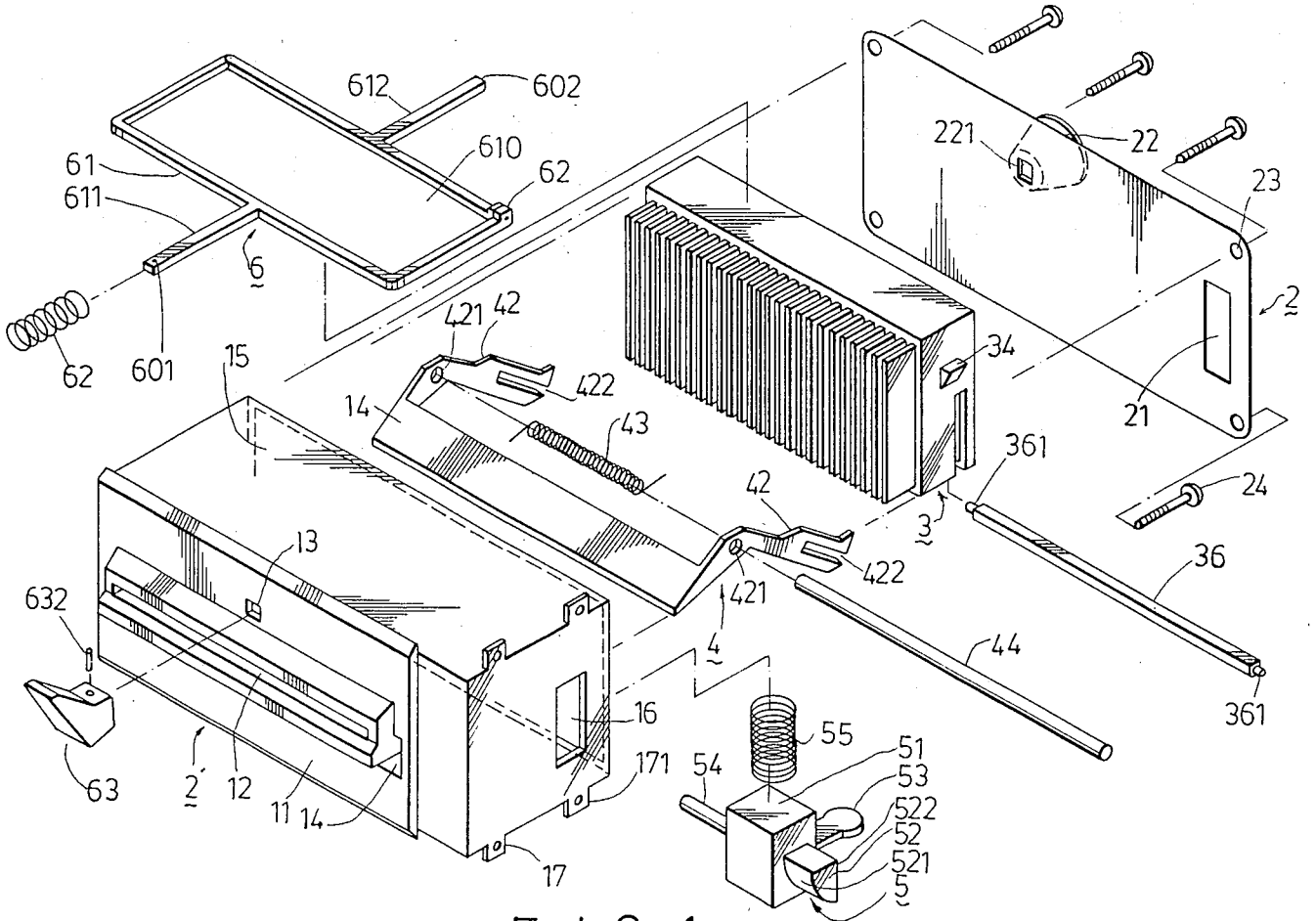
FIG. 1 is an exploded and perspective view of a preferred embodiment of a coded-card type lock device according to this invention.

Referring to FIG. 1, the preferred embodiment of a coded-card type lock device according to this invention comprises in combination: an outer housing body 1; a locking unit 3 fixedly installed in the outer housing body 1; an operating mechanism 4 disposed in the outer housing body 1 in connection with the locking unit 3; a locking bolt mechanism 5 provided in the front end of the outer housing body 1 in conjunction with the operating mechanism 4; a lock bolt mechanism 5 movably disposed at a front portion of the housing body 1 in cooperation with the operating mechanism 4; a resetting member 6 movably disposed around the periphery of the locking unit 3 in the outer housing body 1; an inner covering member 2 detachably coupled with the outer housing body 1; a bolt socket frame 56 fixed on the door frame in accordance with the lock bolt mechanism 5; and a card-type key 4 having its codes arranged in the same arrangement as that of the locking unit for unlocking the locking unit 3.

As shown in FIG. 1, the outer housing body 1 is a rectangular structure, and includes: a panel plate 11 on one side, having a key slot 12 horizontally formed in the middle, a rod opening 13 located at the center, and a plate trough 14 parallel to the key slot 12 below; an open section 15 on another side opposite the panel plate 11; a bolt opening 16 located at the front side adjacent to the panel plate 11; and a plurality of anchoring studs 17 symmetrically provided at the front edge, each of the studs 17 having a screw hole 171 in the center.

Figure 2:
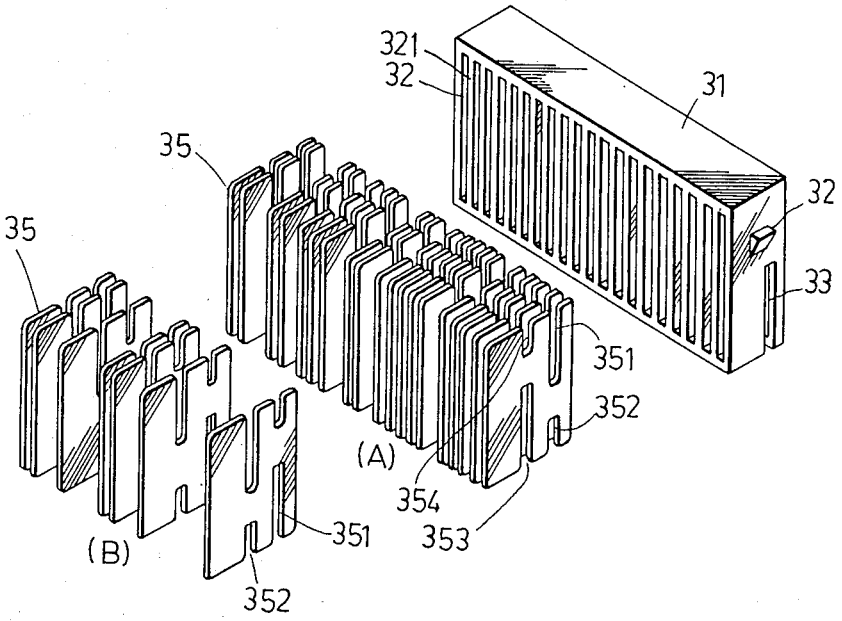
FIG. 2 is an exploded and perspective view of a locking unit embodied in the coded-card type lock device shown in FIG. 1.

Referring to FIGS. 1 and 2, the locking unit 3 comprises: a lock casing structure 31 in a rectangular shape with a plurality of partitioning spaces 32 evenly defined throughout the casing structure 31 by a plurality of partitioning pieces 321, an open sliding slot 33 horizontally formed across the sides of the partitioning pieces 321 at one side, and a projecting piece 34 respectively provided on the opposite sides (the one on the other side cannot be seen in the drawing) above the sliding slot 33; a plurality of mechanically coded locking pieces 35 formed in conjunction with the partitioning spaces 32 for being reversibly arranged therein through individual insertion; and a sliding rod 36 corresponding to the sliding slot 33 provided for horizontally sliding in and out of the slot 33. Each of the locking pieces 35 is designed on the basis of the binary configuration, having a first pair of a first long notch 351 and a first short notch 352 and a second pair of a second long notch 353 and a second short notch 354 formed parallel to each other but inversely disposed through the surface thereof wherein the long notch resembles the digit "1" while the short notch resembles the digit "0" as used in computer language. Also, the width of both the long and the short notches is the same as that of the sliding slot 33, but only the depth of the long notches 351 and 353 is identical with that of the sliding slot 33. When the locking pieces 35 are respectively inserted into the spaces 32 in the way as shown in (A) of FIG. 2, i.e. in an inverted direction with the first long notch 351 at the upper front, only the first short notches 352 are aligned with the sliding slot 33, and the second long notches 353 can be aligned with the sliding slot 33 by being pushed farther forward from that position; while, if the locking piece 35 are separately inserted into the space 33 in the way shown in (B) of FIG. 2, i.e. in a forward direction with the first long notch 351 located at the lower front, the first long notches 351 are all automatically aligned with the sliding slot 33. It is to be understood that only when all the long notches 351 and 353 located at the lower end of the locking pieces 35 are completely aligned with the sliding slot 33, can the sliding rod 36 be horizontally moved in and out through the sliding slot 33.

It is preferable that both the partitioning spaces 32 and the locking pieces 35 are prepared in a group of "26" so that the codes can be arranged either in digital form or in English alphabetical order (from A to Z). For example, if the alphabetical form is adopted by marking the partitioning spaces 32 from A to Z, a proper code name such as "GOOD LUCK" can be selected for setting the locking pieces 35 in the spaces 32. In this case, the locking pieces 35 arranged in the spaces corresponding to the letters G, O, D, L, U, C and K (wherein only one letter is taken for the double O and so forth) are respectively inserted into the spaces of G, O, D, L, U, C and K in the forward direction, i.e. the first long notches 351 of the locking pieces 35 are at the lower front, while the rest of the locking pieces 35 are separately inserted into the remaining spaces in the inverse direction, i.e. the first long notches 351 are at the upper front, while the second long notches 353 are behind the first short notches 352 as respectively shown in (A) and (B) of FIG. 2. In this way, and all the locking pieces 35 are uniformly arrayed in the partitioning spaces 32 of the lock casing structure 31 as shown in FIG. 1 but only the first long notches 351 of those locking pieces 35 contained in the spaces of G, O, D, L, U, C and K are completely aligned with the sliding slot 33 of the casing structure 31. In this condition, the sliding rod 36 cannot be moved upward into the sliding slot 33 until all the other locking pieces 35 blocking it are respectively pushed forward so as to have their second long notches 353 aligned with the sliding slot 33.

It is to be understood that when the locking pieces 35 are inserted into the partitioning spaces 32 in the inverse direction as shown in (A) of FIG. 2, the first short notches 352 are aligned with the sliding slot 33 so that the sliding rod 36 can only be received therein without being able to move upward therefrom. Moreover, owing to the fact that the locking pieces 35 can be inversely placed in the partitioning spaces 32, the code can be reset at any time as the situation requires to promote the security of the locking unit 3. For instance, if the user considers that the original code "GOOD LUCK" is not safe, any another code such as "MY LOVE", "HOLLO", etc., can be substituted simply by placing the locking pieces 35 in the partitioning spaces 32 according to the new code selected for the locking unit 3. This alternating configuration of long and short notches in the locking pieces 35 is the same as the alternating arrangement of "0" and "1" in the code system of a computer. Of course, the code arrangement of the locking unit 3 has to be matched by a special key which will be described and illustrated in the following paragraphs.

The casing structure 31 of the locking unit 3 is fixedly installed in the outer housing body 1 against the the top and the bottom sides thereof, and the locking pieces 35 are respectively inserted into the partitioning spaces 32 through the open section 15 of the outer housing body 1 according to the code-name arrangement as described above so that re-arrangement of the locking pieces 35 can be conveniently made as required in the partitioning spaces 32.

Figure 3:
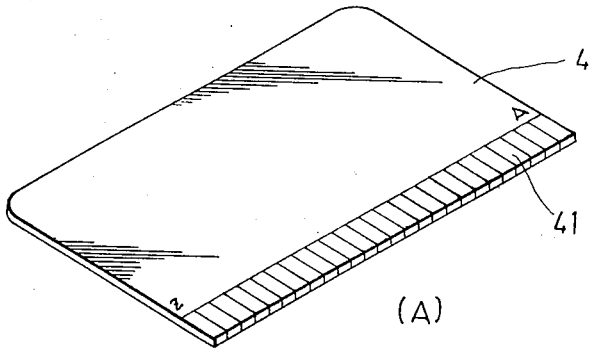
FIGS. 3A and 3B are illustrative views of a card-type key embodied in the coded-card type lock device of FIG. 1.
FIG. 3C is a perspective view of a card-type key and the locking unit.
Figure 3:
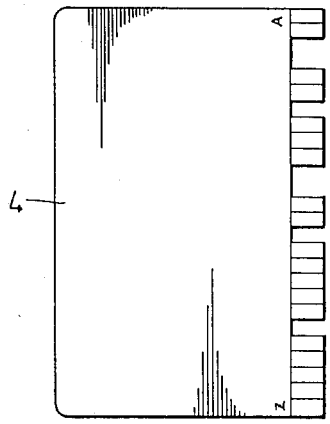
Figure 3:
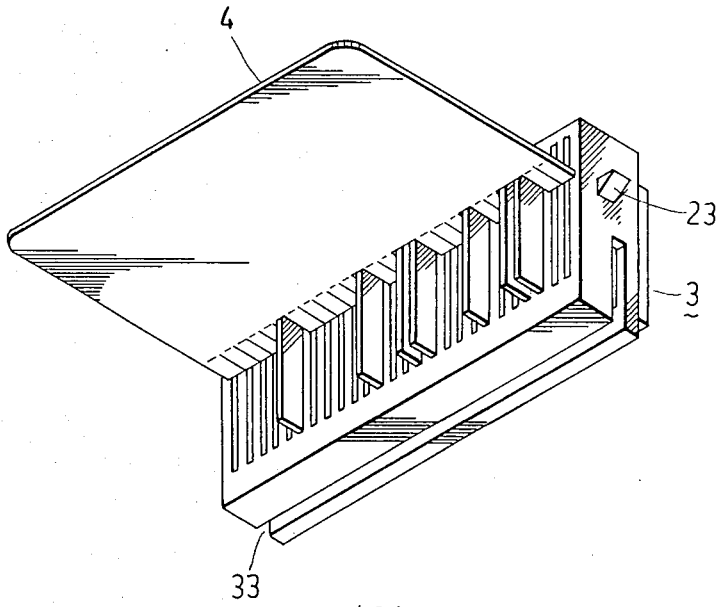

Referring to FIG. 3, a preferred embodiment of a coded-card type key according to this invention comprises a key body 4 which is formed in a calling-card shape with a length and thickness identical with the space of the key slot 12 in the outer housing body 1, and a plurality of segmented tooth-like sections 41 are provided at the front edge thereof. The quantity and size of the segmented tooth-like sections 41 are preferably the same as that of the partitioning spaces 32 of the locking unit 3 for being coordinated with the same numeral or alphabetical arrangement, and the tooth-like sections 41 can be individually removed for setting a code name similar to that of the locking unit 3. As shown in FIG. 3B, the tooth-like sections 41 corresponding to the letters of the code name "GOOD LUCK" are respectively removed (wherein the double letter "OO" is taken as a single letter and so forth) to form a coded-card key so that when the coded-card key 4 is inserted into the key slot 12 of the outer housing body 1, it will push all the locking pieces 35 forward except those locking pieces arranged in the partitioning spaces of G, O, D, L, U, C and K as shown in FIG. 3C. Therefore, the first long notches 351 of the locking pieces 35 corresponding to the code name "GOOD LUCK" and the second long notches 353 of the other locking pieces are all aligned with the sliding slot 33 so as to enable the sliding rod 6 to slide upward into the sliding slot 33 for effecting the unlocking operation therefrom.

Figure 4:
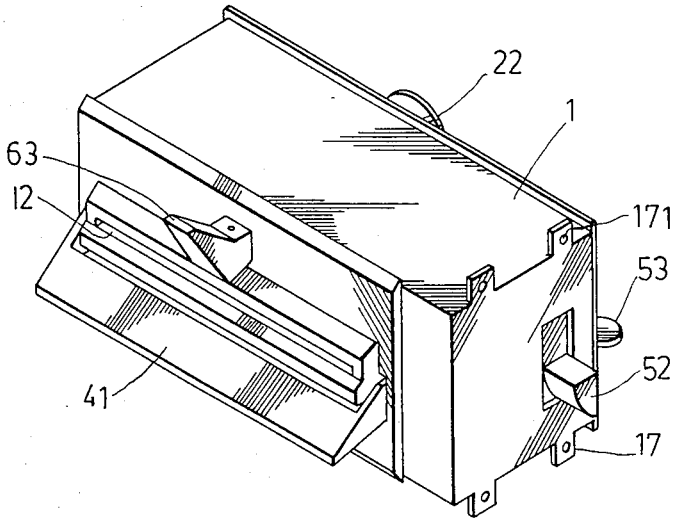
FIG. 4 is an assembled view of the preferred embodiment of FIG. 1.

Referring to FIGS. 1 and 4, the operating mechanism 4 includes: a press plate 41 formed in a U-shape with a curved lever 42 extending at its opposite ends, an axle hole 421 respectively located at the lower portion of the curved lever 42, and a holding slot 422 separately provided at both ends of the curved lever 42; and a turning axle 44 disposed in between the axle holes 421 through a spring 43. The operating mechanism 4 is movably installed in the outer housing body 1 below the locking unit 3 with press plate 41 extending out of the plate slot 14 and the turning axle 44 rotatably engaged with the inner side of the outer housing body 1, and both ends of the spring 443 are fixed in the housing body 1 so a torsional force is applied to the turning axle 44 and the press plate 41 as a whole. The sliding rod 36 with a connecting head 361 at each end is horizontally secured at the curved lever 42 in the holding slot 422, and located adjacent to and in line with the sliding slot 33 so that when all the long notches of the locking pieces 35 are aligned with the sliding slot 33 through the operation of the coded-card type key 4, the sliding rod 36 can be moved into the sliding slot 33 with the press plate 41 pushed downward thereat. However, if the long notches of the locking pieces 35 are not aligned with the sliding slot 33, the press plate 41 cannot be pushed down nor can the sliding rod 36 be moved upward into the sliding slot 33.

Figure 7:
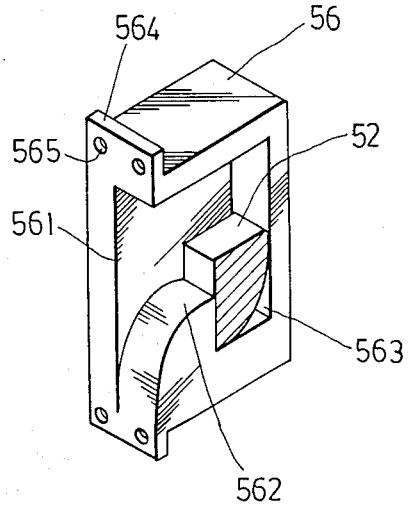
FIG. 7 is a perspective view of a lock-bolt frame embodied in the coded-card type lock device of FIG. 1.

Referring to FIGS. 1, 4 and 7, the lock bolt mechanism 5 includes a bolt body 51 in a cubic shape with a wedge-like bolt 52 extending at the front and having an inclined surface 521 on one side and a flat surface 522 on the other, a projecting bar 54 at the rear, and a caging knob 53 at the inner side. The bolt mechanism 5 is movably installed in the front portion of the outer housing body 1 with the wedge-like bolt 52 extending out of the bolt opening 16 (as shown in FIG. 4) and the end of the projecting bar 54 abutting on the upper edge of the curved lever 42. In the meantime, a compression spring 55 is disposed in an accommodating space (not shown) formed on three side walls of the housing body 1 over the bolt body 51 and secured between the top side of the accommodating space and the top surface of the bolt body 51 so as to keep the wedge-like bolt normally in a downward position. Therefore, the lock bolt mechanism 5 will be moved up and down along with the up-and-down movement of the curved lever 42 of the operating mechanism 4 for performing locking and unlocking actions thereat. Besides, the caging knob 53 can also be conveniently operated by hand for the same operation at the inner side of the door.

Referring to FIG. 7, the lock bolt mechanism 5 further includes a bolt socket frame 56 for being fixed on the door frame or on a post opposite the front side of the outer housing body 1 according to the location of the bolt head 52. The bolt socket frame 56 comprises: an open section 561 formed amid two adjacent sides; an inclined portion 562 provided on the bottom surface, defining a longitudinal space 563 at one inner side of the socket frame 56 for receiving the wedge-like bolt head 52 of which the inclined surface 521 is located opposite to the inclined portion 562 for facilitating the sliding-in movement of the bolt head 52 during the closing of the door; and a flange 564 with a plurality of screw holes 565 formed at both the upper and the lower edges of the socket frame 56 for being fastened on the door frame. It shall be appreciated that the bolt head 52 is to be moved up and down within the space 563 during the unlocking and locking operations.

Referring to FIGS. 1 and 4, the resetting member 6 includes: a rectangular frame structure 61 with an open section 610 formed larger than the periphery of the locking unit 3; a first linking rod 611 located perpendicular to its front long side; and a second linking rod 612 perpendicular to its rear long side, which is detachably coupled with the two opposing short sides of the front long side. The assembled frame structure 61 is movably installed around the upper periphery of the locking unit 3 in the outer housing body 1 with the opposing short sides slidingly engaging the projecting pieces 34 and the first linking rod 611 coupled with a spring 62 extending out of the rod opening 13 for being connected with a hand grip 63 (as shown in FIG. 4) through a coupling pin, which is fixed in a pin hole in the grip 63 and a pin hole 601 in the first linking rod 611 so that by pulling the hand grip 63 at the outside of the door, after the locking pieces 35 are respectively pushed forward during the unlocking operation, all the locking pieces 35 will be moved back to their original coded position for locking the unit.

As shown in FIGS. 1 and 4, the inner covering member 2 in a rectangular shape with a knob opening 21 in its front side, a cone-shaped connector 22 with an orifice 221 in the center at its upper side and a plurality of screw holes 23 at its four corners, is connected to the outer housing body 1 by screws over the open section 15 with the lock knob 53 located in the knob opening 21 and the end of the second linking rod 612 movably connected to the cone-shaped connector 22 through the orifice 221. It is to be understood that the unlocking operation at the inner side of the door is made by lifting the lock knob 53 so as to move the bolt head 52 upward and open the door therefrom.

Figure 5:
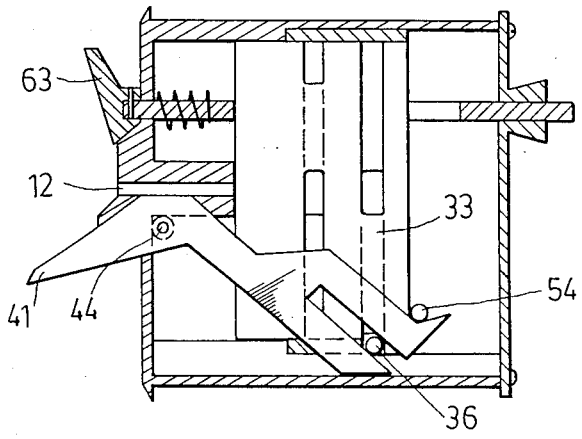
FIG. 5 is an illustrative view of an operating mechanism embodied in the coded-card type lock device shown in FIG. 1.
Figure 6:
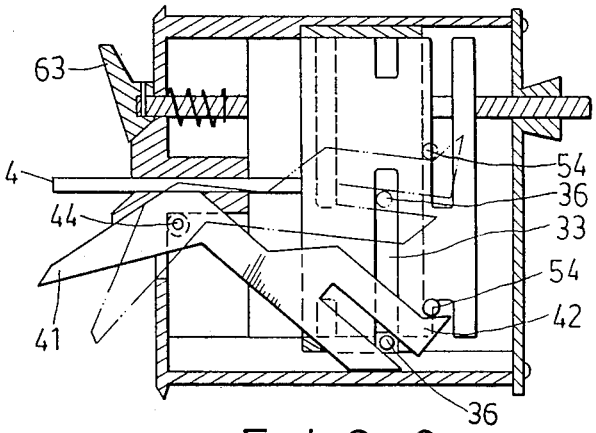
FIG. 6 is an illustrative view of the operating mechanism shown in FIG. 5 when being pressed downward.

The assembled coded-card type lock device according to this invention is as shown in FIG. 4, and the locking and unlocking operations are respectively illustrated in FIGS. 5 and 6. As shown in FIG. 5, when the lock device is in the locked condition, the press plate 41 cannot be pushed down because the sliding slot 33 is blocked by the locking pieces 35, and the sliding rod 36 cannot be moved therein. However, when the coded-card key 4 is inserted into the key slot 12 and pushed forward, all the long notches (either the first ones or the second ones) located at the lower end of the locking pieces 35 are aligned with the sliding slot 33, as shown in FIG. 6, and the press plate 41 can be pushed downward, causing the sliding rod 36 to be moved upward into the sliding slot 33. In this condition, the curved lever 42 on which the projecting bar 54 of the bolt body 51 is abutted, is moved up together with the bolt body 51, so that unclocking operation is effected therewith. When the door is closed or the press plate 41 is released thereat, the bolt body together with its bolt head 52 will be automatically moved down through the elastic force of the spring 55 as well as the downward action of the operating mechanism 4 and positioned in the space 563 as shown in FIG. 7. It shall be understood that, at this point, the lock head 52 is not in locked condition because the press plate 41 can be pushed down as desired until the resetting member 6 is moved back by pulling the hand grip 63 so as to restore all the locking pieces 35 to their original coded positions in the locking unit 3, as described above.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be restored to, as fall within the scope of the invention as claimed.

What I claim is:

1. A coded-card type lock device comprising in combination:

an outer housing body with an open section at one side, a panel plate formed on another side, a bolt opening and a plurality of anchoring studs provided at a front portion for being fixed at a proper location in a door, said panel plate including a key slot horizontally formed in the middle, a rod opening located at a place over the key slot, and a plate trough below and parallel to the key slot for being exposed on the outer surface of the door;

a locking means with a plurality of coded and movable locking pieces fixedly installed in said outer housing body with a line of said coded and movable locking pieces exposed along the key slot for performing locking and unlocking operations;

an operating means with a press member and a turning arrangement movably installed in said outer housing body under said locking means with the press member extending out of the key slot for controlling the unlocking operation in conjunction with said locking means;

a lock bolt mechanism having a bolt head and a projecting member flexibly installed in the front portion of said outer housing body with the bolt head extending out of the bolt opening for being moved up and down along with said operating means to effect the locking and unlocking operations;

a resetting member formed in a rectangular frame structure with a first linking rod at one side and a second linking rod at another movably installed around an upper periphery of said locking means in said outer housing body with the first linking rod extending out of the rod opening of outer housing body for resetting the locking pieces of said locking means to their coded positions therein;

an elastic element coupled with the first linking rod in said outer housing body for applying an elastic force to said resetting means;

a hand grip connected to the first linking rod at the panel plate of said outer housing body for operating said restoring means;

an inner covering member with a knob opening at one side and a cone-shaped connecting part with an orifice in its center formed at an upper portion thereof connected to said outer housing body over the open section thereof with the second linking rod movably connected to the cone-shaped connecting part;

a bolt socket frame having a locked space defined therein accommodating the bolt head of said bolt mechanism for being fixed on a door post opposite to the front portion of said outer housing body; and a card-type key having a plurality of segmented tooth-like sections formed at one side, in cooperation with the key slot of said outer housing body, for being coded according to a code arrangement of the locking pieces of said locking means; whereby, the lock device can be locked and unlocked conveniently with a high standard of security.

2. A coded-card type lock device according to claim 1 wherein said locking means comprises:

a lock casing structure having a plurality of partitioning spaces evenly defined by a plurality of partitioning pieces provided through the casing structure, an open sliding slot horizontally formed across said partitioning pieces and spaces, and a projecting piece located at each side opposite to each another; and a plurality of locking pieces movably and respectively arranged in said partitioning spaces, each of said locking pieces being mechanically coded with a plurality of notches respectively formed at an upper portion and a lower portion thereof and located with one notch opposite to another, said notches provided in each locking piece including long notches and short notches parallel to and longitudinally in line with each other, and the long notches being formed in conformity with the sliding slot for being aligned therewith during the unlocking operation.

3. A coded-card type lock device according to claim 2 wherein each of said locking pieces can be inversely re-arranged in the partitioning spaces for the code setting operation.

4. A coded-card type lock device according to claim 1 wherein said operating means comprises:

a press plate formed in a U-shape with a curved lever extending at each end, each curved lever having an axle hole located at its lower portion and a holding slot at its end for being moved up and down in said locking means;

a turning member movably disposed between the lower portions of the curved levers for being rotated thereat along with the operation of the press plate; an elastic element coupled with said turning member and fixed in said outer housing body for applying a torsional force to both said turning axle and said press plate; and a sliding rod having a connecting head at each end secured between said curved levers through the holding slot for being moved into and out of the sliding slot of said locking means so as to effect the unlocking operation.

5. A coded-card type lock device according to claim 1 wherein said lock bolt mechanism comprises:

a bolt body structure in a cubic shape with a bolt head extending at its front side with an inclined surface on one side and a flat surface on another side, a projecting bar at its rear side, and a caging knob protruding at its inner side for being movably disposed at the front portion of said outer housing body with the projecting bar abutting on an upper edge of one of said curved levers for being moved up and down thereat;

an elastic member disposed between a top surface of the bolt body at one end and a top inner side of said outer housing body for applying a compressing force to the bolt body; and a bolt socket frame having an open section with an inclined portion formed on a bottom surface in conjunction with the inclined surface of said bolt head, a longitudinal space defined in the open section for receiving said bolt head herein, and a flange with a plurality of screw holes formed on its upper and lower edges for being fixed on a door frame in line with the location of said bolt head so as to allow the latter to be moved up and down in the longitudinal space during locking and unlocking operations.

6. A coded-card type lock device according to claim 1 wherein said card-type key comprises a key body formed in a name-card shape with a length and thickness identical with a space of the key slot of said outer housing body, and a plurality of segmented tooth-like sections provided at its front edge, said tooth-like sections being individually removable for setting a code similar to that of said locking means for being inserted into the key slot so as to unlock the lock device therewith.

7. A coded-card type lock device according to claim 6 wherein each of said segmented tooth-like sections is of identical width to that of each said locking pieces so that the latter are separately engaged therewith and are pushed forward for effecting the unlocking operation.

8. A coded-card type lock device according to claim 1 wherein said resetting means comprises:

a frame structure with an open section formed larger than the periphery of said locking means;

a first linking rod located perpendicular to a front long side of the frame structure, the front long side having a short side formed at each end;

a second linking rod perpendicular to a rear long side of the frame structure, which rear long side is detachably coupled with the short side at each end thereof with the end of the second linking rod extending therefrom for being movably connected to said inner covering member;

said assembled frame structure movably installed around an upper periphery of said locking means in said outer housing body with the short side respectively engaging the projecting pieces of said locking case structure, and the fist linking rod extending out of the rod opening of said outer housing body;

an elastic member coupled with the first linking rod in said outer housing body for applying an elastic force thereto; and a hand grip fixed at an end of the first linking rod for being operated by hand in resetting operation.

* * * * *